US006354968B1

(12) United States Patent
Nozato

(10) Patent No.: US 6,354,968 B1
(45) Date of Patent: Mar. 12, 2002

(54) PITCHER PROTECTION NET DEVICE IN BASEBALL PRACTICE

(75) Inventor: Kazu Nozato, Osaka (JP)

(73) Assignee: Toa Sports Machine Incorporated, Osaka (JP)

( * ) Notice: Subject to any disclaimer, the term of this patent is extended or adjusted under 35 U.S.C. 154(b) by 0 days.

(21) Appl. No.: 09/663,825

(22) Filed: Sep. 15, 2000

(30) Foreign Application Priority Data

Jan. 27, 2000 (JP) ..... 2000-019213

(51) Int. Cl.[7] ..... A63B 67/00; A63B 69/36; A63B 69/00; A63B 63/00; A63B 71/00

(52) U.S. Cl. ..... 473/421; 473/197; 473/476; 473/422; 473/439; 273/400; 273/410; 273/398

(58) Field of Search ..... 473/197, 416, 473/421, 451, 454, 455, 456, 458, 468, 499, 500, 501, 503, 195, 196, 478, 476, 490, 439, 422; D21/722, 699; 273/354, 400, 398, 410

(56) References Cited

U.S. PATENT DOCUMENTS 3,013,801 A * 12/1961 Kirkconnell, Jr. ..... 473/421
4,489,941 A * 12/1984 Shieh ..... 473/421
5,118,103 A * 6/1992 Miller ..... 473/197
5,433,433 A * 7/1995 Armell ..... 473/478
5,722,905 A * 3/1998 Bidelman ..... 473/451
5,807,193 A * 9/1998 Talarico et al. ..... 473/421
5,857,679 A * 1/1999 Ringe et al. ..... 273/395
6,083,124 A * 7/2000 Williams ..... 473/421
6,113,507 A * 9/2000 Padilla ..... 473/478
6,210,288 B1 * 4/2001 Kim ..... 473/197
6,299,554 B1 * 10/2001 Sinclair et al. ..... 473/435

* cited by examiner

*Primary Examiner*—Paul T. Sewell
*Assistant Examiner*—Alvin H. Hunter
(74) *Attorney, Agent, or Firm*—Rader, Fishman & Grauer, PLLC

(57) ABSTRACT

A pitcher protection net device in baseball practice having a frame installed on the ground to vertically extend to cover a pitcher from his front. A net closes a space surrounded by the outer edge of the frame and is attached to the frame. The frame includes a main frame forming one lateral portion on one widthwise side. An auxiliary frame projects from the lower portion of the main frame toward the other widthwise side to form the other lateral portion of the frame. The pitcher protection net device in baseball practice includes an extension net that closes a corner space surrounded by this side edge of the upper portion main frame on the other side and the upper edge of the auxiliary frame. The extension net is capable of deflecting downward. The pitcher protection net device also includes an adjusting means for adjusting the amount of deflection of the upper edge to the extension net.

5 Claims, 5 Drawing Sheets

PITCHER PROTECTION NET DEVICE IN BASEBALL PRACTICE

FIELD OF THE INVENTION

The present invention relates to a pitcher protection net device that, in baseball practice, when the ball pitched by the pitcher is hit, prevents the ball from hitting the pitcher.

BACKGROUND OF THE INVENTION

An example of such pitcher protection net device in baseball practice has been disclosed in Japanese Utility Model Registration Application Publication No. 7-19487.

According to the above publication, the net device comprises a frame installed on the ground to vertically extend to cover the pitcher from his front, and a net closing a space surrounded by the outer edge of said frame and attached to said frame. Further, said frame comprises a main frame forming a lateral portion on one widthwise side, and an auxiliary frame projecting from the lower portion of said main frame to the other widthwise side to form the other lateral portion of said frame.

In the above case, the auxiliary frame comprises a fixed frame attached to the lower portion of the main frame, and a movable frame installed to be capable of being projected upward from said fixed frame, whereby the height of the upper edge of said auxiliary frame is made adjustable.

When batting practice for baseball is to be done using said net device, first, said net device is installed on the ground forwardly of and adjacent the pitcher.

The pitcher will be sometimes a tall one and sometimes a short one; therefore, a ball to be pitched by a pitcher toward the batting zone for the batter will be pitched forward through a higher position or a lower position. Thus, the height of the upper edge of the auxiliary frame is adjusted such that the pitched ball passes above and adjacent the upper edge of the auxiliary frame.

Therefore, interference of the auxiliary frame with the pitcher's pitching action is prevented. Further, when the pitcher bends forward upon completion of the pitching action, he is substantially completely covered from front by the net device. Therefore, even if the ball hit immediately after being pitched flies toward the pitcher, this ball will hit the net device, prevented from hitting the pitcher and hence the pitcher is protected.

According to said prior art net device, in order to make adjustable the height of the upper edge of the auxiliary frame, the auxiliary frame comprises the fixed frame attached to the lower portion of the main frame, and the movable frame installed to be capable of being projected upward from said fixed frame. Thus, since the number of parts of said net device is large, the arrangement thereof is complicated, leading to a problem that the production is troublesome.

Further, since the number of parts of the frame is large, as described above, the weight of the net device increases, making it troublesome to carry the net device.

SUMMARY OF THE INVENTION

An object of the invention is to facilitate the production of a net device that ensures that when a ball pitched by a pitcher is batted, the pitcher is protected by preventing this ball from hitting the pitcher.

Another object of the invention is to make it easy to carry said net device.

Another object of the invention is to ensure that the net device does not interfere with pitching and that the pitcher is more reliably protected from the batted ball.

The present invention provides a pitcher protection net device in baseball practice, comprising a frame installed on the ground to vertically extend to cover a pitcher from his front, and a net closing a space surrounded by the outer edge of said frame and attached to said frame, said frame comprising a main frame forming one lateral portion thereof on one widthwise side, and an auxiliary frame projecting from the lower portion of said main frame toward the other widthwise side to form the other lateral portion of said frame, wherein the net device includes an extension net that closes a corner space surrounded by the side edge of the upper portion of said main frame on said other side and the upper edge of said auxiliary frame and that is capable of deflecting downward, and an adjusting means for adjusting the amount of deflection of the upper edge of said extension net.

Other objects, arrangements, functions and effects than those described above will become more apparent from a detailed description of the invention to be given below.

BRIEF DESCRIPTION OF THE DRAWINGS

The drawings show preferred embodiments of the present invention.

DETAILED DESCRIPTION OF THE PREFERRED EMBODIMENTS

Figure 1:
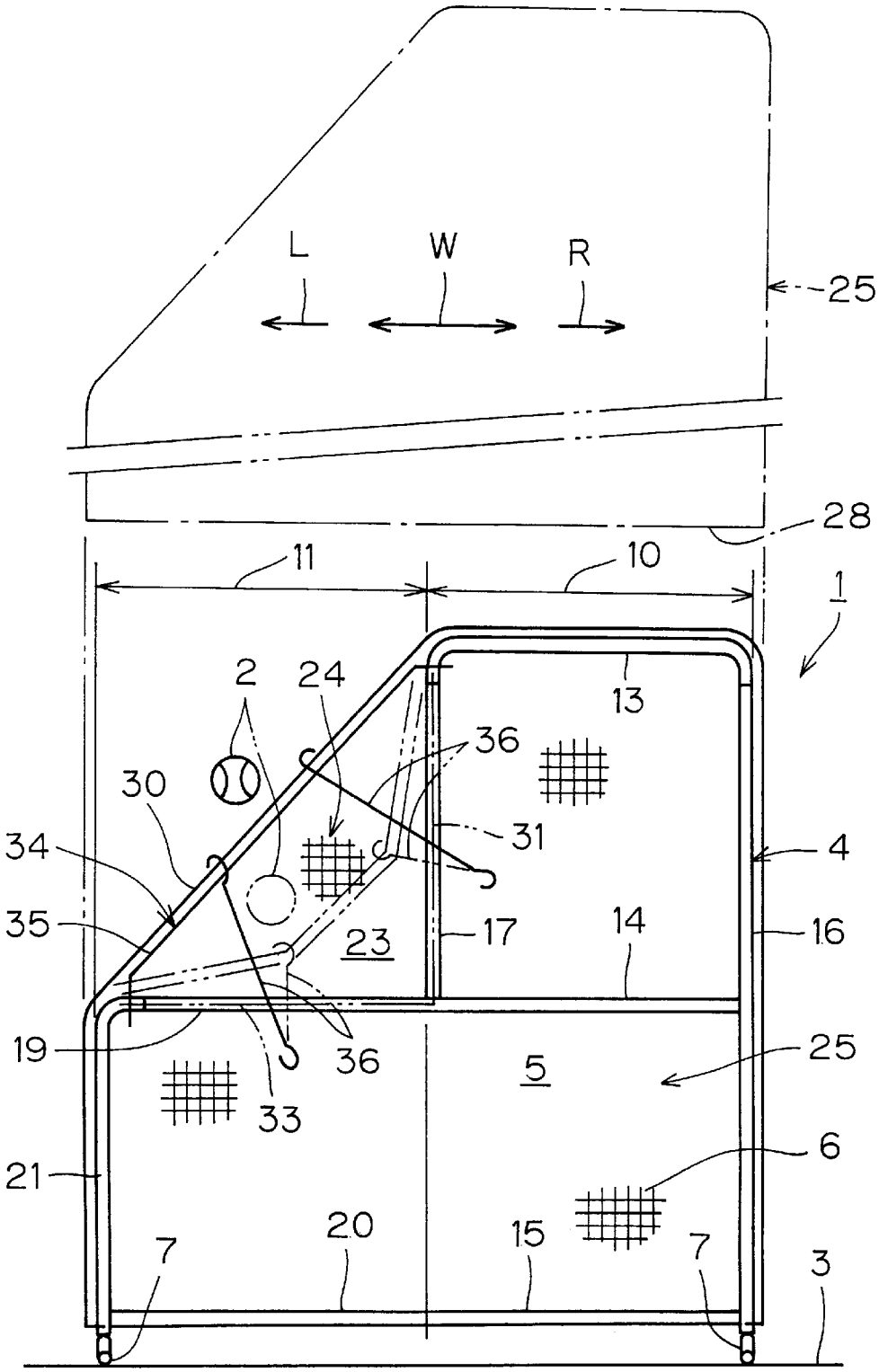
FIG. 1 is a complete front view of a net device.
Figure 2:
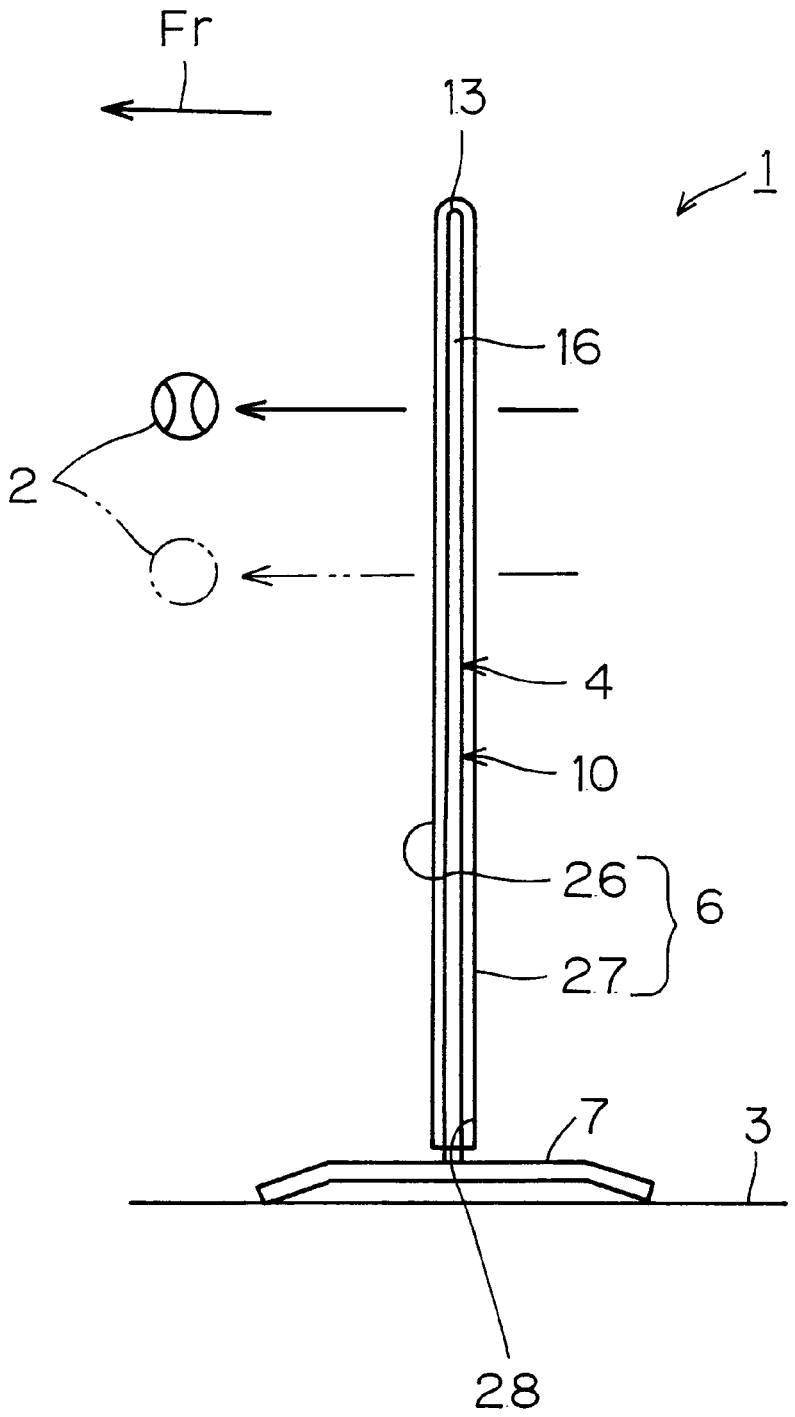
FIG. 2 is a complete side view of the net device.

In FIGS. 1 and 2, the numeral 1 denotes a pitcher protection net device in batting practice for baseball. In FIG. 2, the arrow Fr indicates the forward direction in which a pitcher throws a ball 2 toward the batting zone for a batter.

The net device 1 comprises a frame 4 to be installed on the ground 3 and extending vertically to cover a pitcher from his front, a flexible net 6 closing a space 5 surround by the outer edge of the frame 4 and attached to the frame 4, and a pair of legs 7 for enabling the frame 4 to stand by itself on the ground 3.

The frame 4, as seen in a front view thereof, comprises a main frame 10 forming one side portion in one side R in the width direction W, and an auxiliary frame 11 projecting from the lower portion of the main frame 10 to the other side L in the width direction W to form the other side portion of the frame 4.

The main frame 10 comprises an upper member 13, an intermediate member 14 and a lower member 15 that extend substantially parallel in the width direction W in vertically spaced relation to each other, a vertical member 16 vertically extending to interconnect said members 13, 14 and 15 at their ends on said one side R, and another vertical member 17 vertically extending to interconnect said upper member 13 and intermediate member 14 at their ends on said other side L.

The auxiliary frame 11 comprises an upper member 19 and a lower member 20 that extend substantially parallel in the width direction W in vertically spaced relation to each other, and a still another vertical member 21 vertically extending to interconnect said members 19 and 20 at their ends on the other side L. The intermediate member 14 of the main frame 10 and the upper member 19 of the auxiliary frame 11 are integrally formed on their common axis. Further, the lower member 15 of the main frame 10 and the lower member 20 of the auxiliary frame are integrally formed on their common axis. One of the two legs 7 is attached to the lower end of the vertical member 16 and the other leg 7 is attached to the lower end of said still another vertical member 21.

The space between said another vertical member 17, which is the side edge of the upper portion of the main frame 10 on the other side L, and the upper member 19, which is the upper edge of the auxiliary frame 11 is a corner space 23 that is substantially triangular as seen in a front view of the net device 1, and a substantially triangular extension net 24 is provided that closes said corner space 23. The net 6 and the extension net 24 are integrally formed to provide a combination net 25.

The combination net 25 is of bag form such that it can be removably fitted on said frame 4 from above. The combination net 25 has a pair of front and rear nets 26 and 27 closely opposed to each other. The upper edges of these front and rear nets 26 and 27 are sewn together and so are the lateral edges in the width direction W. Defined between the lower edges of the front and rear nets 26 and 27 is a flat opening 28 that establishes communication between the interior and exterior of the combination net 25, so that the combination net 25 can be removably fitted on the frame 4 through said opening 28.

The upper edge 30 of the extension net 24 is obliquely downwardly inclined to extend from the upper end of said another vertical member 17 toward the end of the upper member 19 on the other side L. As particularly shown in FIG. 3, the side edge 31 of the extension net 24 on one side R is connected to said another vertical member 17, which is the upper side edge of said main frame 10, by a connector 32, such as a rope. On the other hand, the lower edge 33 of said extension net 24 is connected to the upper member 19, which is the upper edge of said auxiliary frame 11, by said connector 32.

The extension net 24 is downwardly flexible, and there is provided an adjusting means 34 by which the amount of downward deflection of the upper edge 30 of the extension net 24 can be adjusted. The adjusting means 34 comprises a regulator 35 preventing the amount of downward deflection of the upper edge 30 of said extension net 24 from exceeding a desired value, and a plurality of tensioners 36 making it possible to pull the upper edge 30 of said extension net 24 downward.

The regulator 35 is in the form of a rope extending along the upper edge 30 of the extension net 24 and slidably connected to the various longitudinal portions of the upper edge 30. More particularly, this regulator 35 slidably weaves its way through a longitudinal row of net openings in said upper edge 30.

Figure 3:
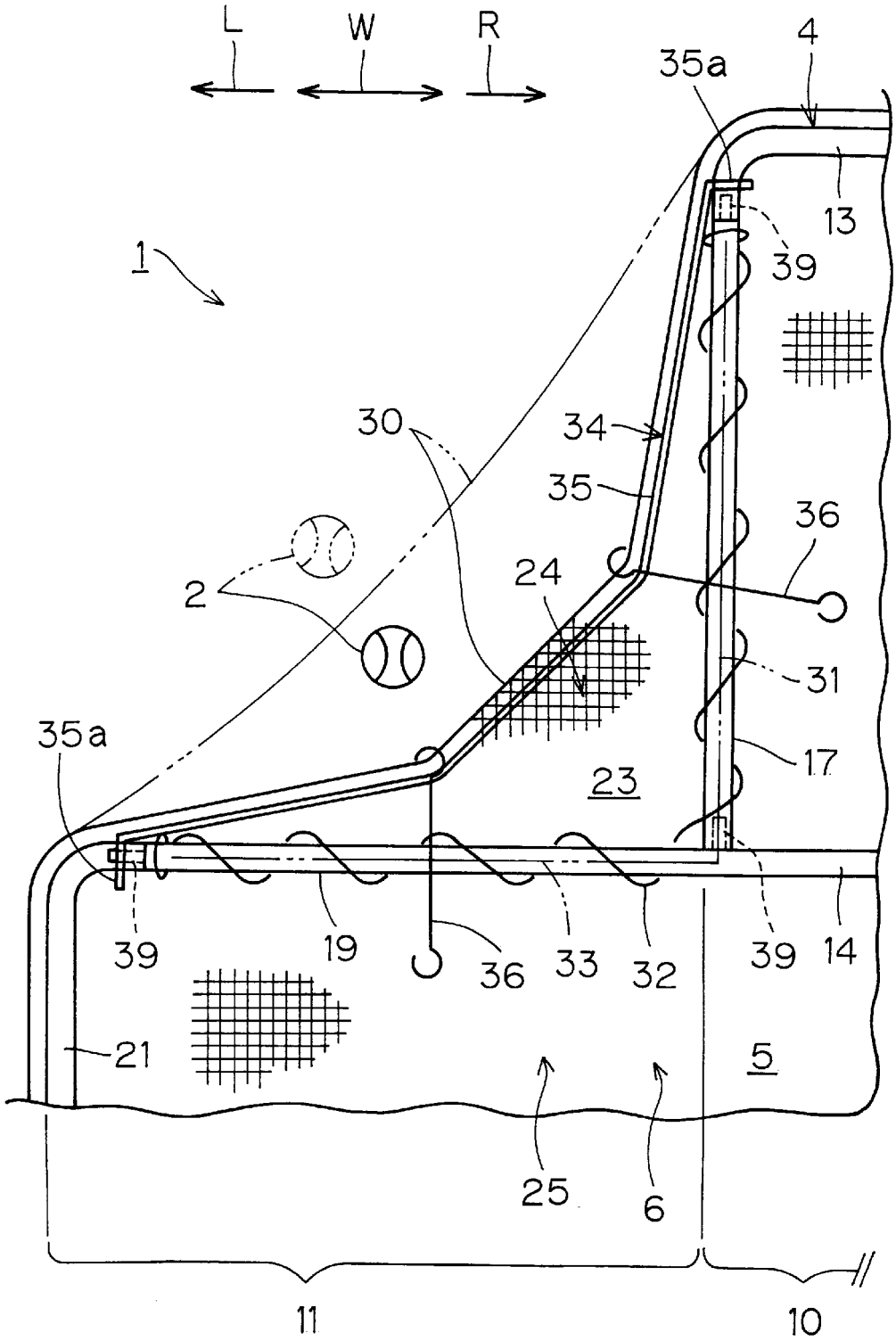
FIG. 3 is a fragmentary enlarged explanatory view of FIG. 1.

The regulator 35 is removably connected at the longitudinal ends thereof to portions of either the frame 4 or the net 6 by tying; particularly the reference character 35*a* in FIG. 3 shows tied portions. By adjusting the positions at which the regulator 35 is connected to the frame 4 and the net 6, the extension net 24 can be tautened and the amount of deflection of the extension net can be adjusted. Thereby, the amount of downward deflection of the upper edge 30 of the extension net 24 is adjusted. In other words, the height of the upper edge 30 of the extension net 24 is adjustable.

Each tensioner 36 is a rope or an elastic body, such as spring and is formed at the ends thereof with hooks. The hook at one end of each tensioner 36 is removably connected to the upper edge 30 of said extension net 24 and the hook at the other end is removably connected to a portion of either the lower frame 4 or the net 6 below the level of said upper edge 30.

If the upper edge 30 is pulled downward by the tensioners 36 until the amount of deflection of the upper edge 30 of the extension net 24 is regulated to a desired value by said regulator 35, the upper edge 30 is adjusted more accurately to a desired height, and the adjusted height is held more reliably. Further, by the use of said tensioners 36, it is possible to adjust the various longitudinal portions of the upper edge 30 of the extension net 24 to respective desired heights.

In addition, said adjusting means 34 needs not necessarily be provided with the tensioners 36. In this case, said regulator 35 is somewhat loosened to allow the upper edge 30 of the extension net 24 to assume an arcuate form shown in chain triple-dashed lines in FIG. 3 under the weights of the regulator 35 and extension net 24, whereby the height of the upper edge 30 of the extension net 24 can be adjusted.

In making batting practice for baseball using said net device 1, first, the net device 1 is installed on the ground 3 close to and in front of the pitcher.

As shown in solid lines in FIGS. 1 and 2, in the case of a taller pitcher, the ball 2 to be pitched by the pitcher will be pitched forward moving at a higher level. Therefore, the upper edge 30 of the extension net 24 is adjusted to a higher position by manipulating the regulator 35 and tensioners 36 of the regulating means 34 so that the thus pitched ball 2 may pass above and adjacent the upper edge 30 of the extension net 24.

As shown in chain double-dashed lines in FIG. 1 and in solid lines in FIG. 3, in the case of a less tall pitcher, the ball 2 to be pitched by the pitcher will be pitched forward moving at a lower level. Therefore, the upper edge 30 of the extension net 24 is adjusted to a lower position by manipulating the regulator 35 and tensioners 36 of the regulating means 34 so that the thus pitched ball 2 may pass above and adjacent the upper edge 30 of the extension net 24.

Therefore, the pitching action of each pitcher is protected from being obstructed by the upper edge 30 of the extension net 24. Further,when each pitcher bends forward upon completion of the pitching action, he is substantially completely covered from front by the net device 1. Therefore, even if the ball hit immediately after being pitched flies toward the pitcher, this ball will hit the net device 1, prevented from hitting the pitcher and hence the pitcher is protected.

Figure 4:
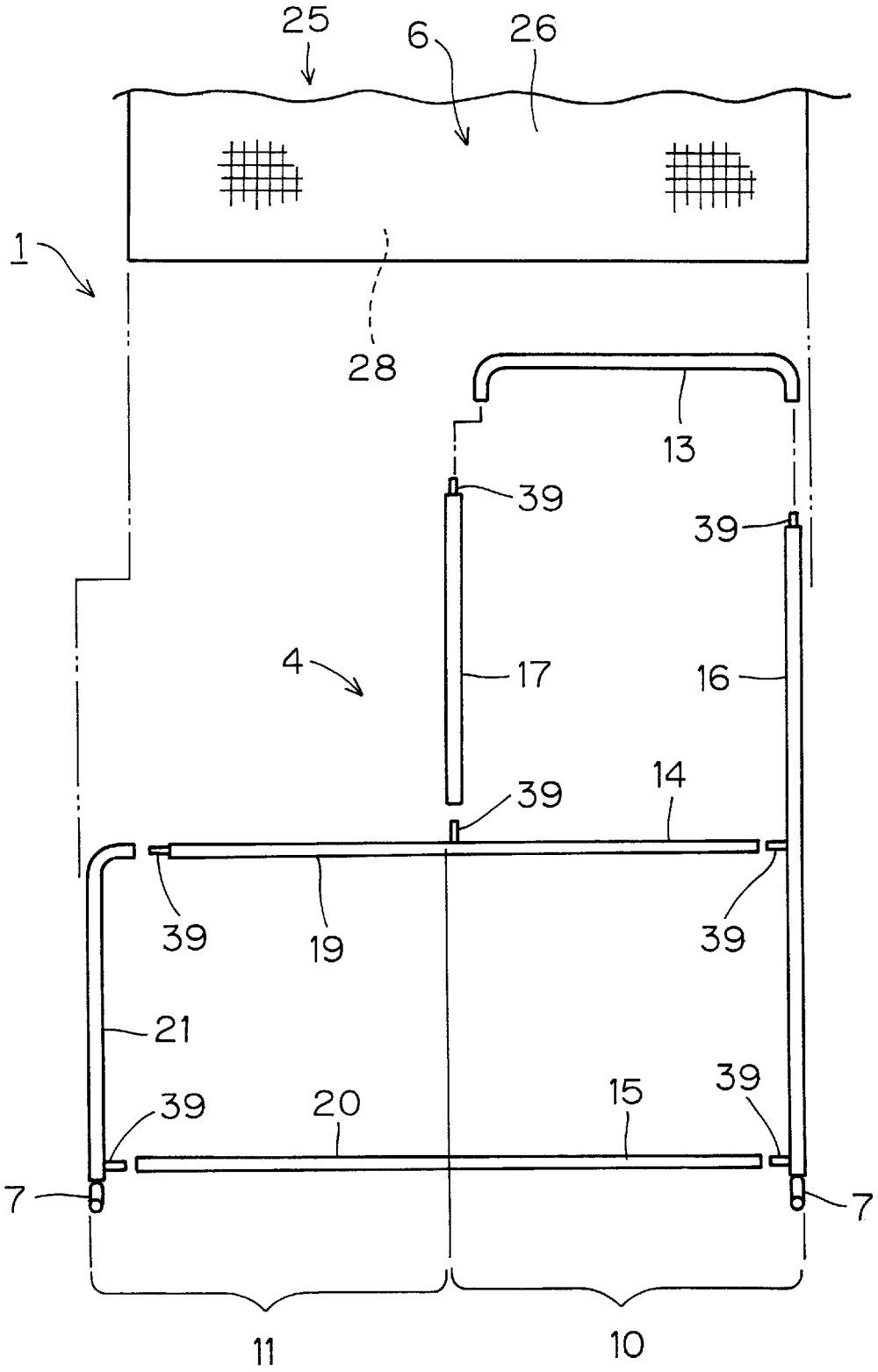
FIG. 4 is a front developed view of the net device.

In FIG. 4, the members 13, 14, 15, 16, and 17 of the main frame 10 and the members 19, 20, and 21 of the auxiliary frame 11 and the legs 7 are respectively of the same size and made of metal or resin in the form of round pipes and their connecting portions are respectively separably connected by fit-type connecting means 39.

The disassembled members and the folded combination net 25 are compactly housed in an unillustrated case for easy transportation.

According to the above arrangement, an extension net 24 is provided that closes a corner portion 23 defined by the side edge of the upper portion of the main frame 10 on said other side L and the upper edge of the auxiliary frame 11 and that is downwardly flexible, and there is provided an adjusting means 34 by which the amount of deflection of the upper edge 30 of the extension net 24 can be adjusted.

Thus, when the net device 1. is to be used, the height of the upper edge 30 is adjusted to a desired value by manipulating said adjusting means 34 to adjust the amount of deflection of the upper edge 30 of the extension net 24 such that irrespective of the pitcher's height, the ball 2 pitched by the pitcher passes above and adjacent the upper edge 30. Then, the pitching is protected from being obstructed by the upper edge 30 of the extension net 24 and each pitcher is protected from a ball hit.

And in the net device 1, when the height of the upper edge 30 of the extension net 24 is to be adjusted according to the pitcher's height, such adjustment is achieved by the deflection of the upper edge 30 of the extension net 24. Thus, as compared with the prior art using a movable frame rather than a fixed frame for such adjustment, the net device 1 of this embodiment is reduced in the number of parts of the frame 4.

Therefore, the net device 1 is simple in arrangement and easy to produce.

Further, when the number of parts of the frame 4 is reduced, as described above, the weight of the net device 1 is correspondingly reduced, making it easier to carry the net device 1.

Further, as described above, the adjusting means 34 comprises the regulator 35 preventing the amount of downward deflection of the upper edge 30 of said extension net 24 from exceeding a desired value, and tensioners 36 making it possible to pull the upper edge of said extension net 24 downward.

Thus, when the upper edge 30 is pulled downward with said tensioners 36 until the regulator 35 regulates the amount of deflection of the upper edge 30 of the extension net 24 to a predetermined value, the upper edge 30 is adjusted more accurately to a desired height and is more reliably held in this adjusted position. Further, with the use of one or more of said tensioners 36, the various longitudinal portions of the upper edge 30 of the extension net 24 can be adjusted to desired heights.

Therefore, the various portions of the upper edge 30 of the extension net 24 can be respectively more accurately adjusted in height according to each pitcher's height and the pitching form. Thus, according to the net device 1, interference of the upper edge 30 of the extension net 24 with pitching is more reliably prevented and each pitcher is more reliably protected from the batted ball 2.

Further, as described above, the net 6 and the extension net 24 are integrally formed to provide the combination net 25.

As a result, the number of net parts of the net device 1 is further reduced and the net device 1 is correspondingly simple in arrangement and easy to produce.

Further, as described above, the combination net 25 is of bag form such that it can be fitted on the frame 4 from above.

Therefore, the operation of assembling the frame 4 and the combination net 25 of the net device 1 is achieved simply by fitting the combination net 25 on the frame 4.

Thus, assembling operation of the net device 1 is facilitated.

Further, when a right-hand pitcher using the net device 1 is replaced by a left-hand pitcher, the net device 1 may be turned back to front such that the ball 2 pitched after the replacement passes above the upper edge 30 of the extension net 24. In this case, since the combination net 25 is of bag form having front and rear nets 26 and 27, the conditions for use of the combination net 25 are maintained unchanged even if the net device 1 is turned back to front as described above.

Thus, the net device 1 is useful as it can be used for right-handed and left-handed pitchers. Since the combination net 25 is of double construction having the front and rear nets 26 and 27, the protection of pitchers is correspondingly reliable.

Further, as described above, the side edge 31 of the extension net 24 is connected to the upper side edge of the main frame 10, while the lower edge 33 of the extension net 24 is connected to the upper edge of the auxiliary frame 11.

Thus, the shape retention of the extension net 24 as a whole is made more reliable by the main and auxiliary frames 10 and 11.

Therefore, adjustment of the height of the upper edge 30 of the extension net 24 by the adjusting means 34 can be made more reliably, whereby interference of the upper edge 30 of the extension net 24 with pitching is more reliably prevented and pitchers are more reliably protected from the ball 2 that is batted.

Figure 5:
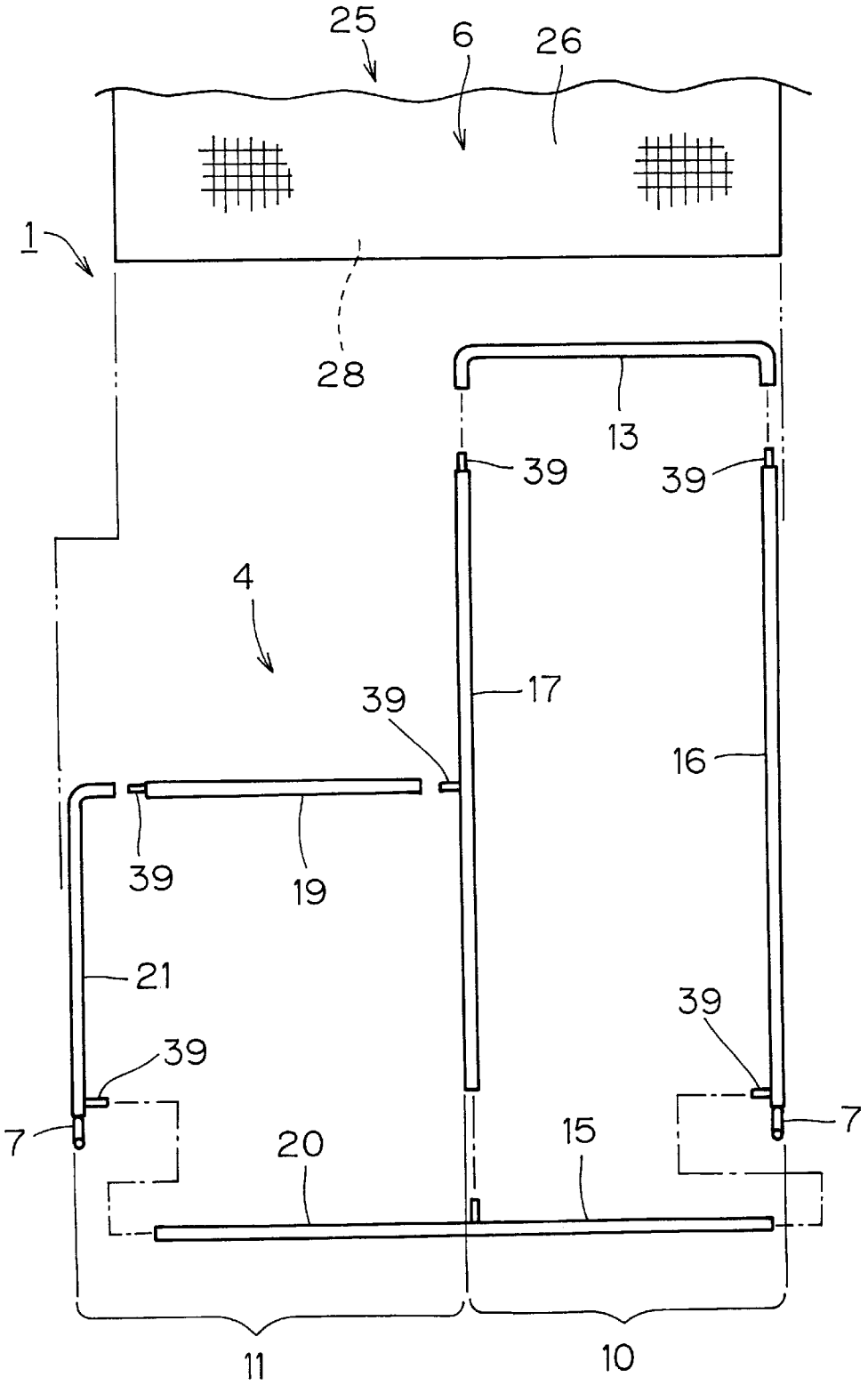
FIG. 5 is a front developed view of a net device, showing another embodiment.

FIG. 5 shows another embodiment of the frame 4.

The main frame 10 of the frame 4 comprises an upper member 13 and a lower member 15 that extend substantially parallel in the width direction W in vertically spaced relation to each other, a vertical member 16 vertically extending to interconnect said members 13 and 15 at their ends on said one side R, and another vertical member 17 vertically extending to interconnect said upper and lower members 13 and 15 at their ends on said other side L.

The longitudinal intermediate portion of said another vertical member 17 of said main frame 10, and the end on one side R of the upper member 19 of the auxiliary frame 11 are interconnected.

The rest of the arrangement is the same as in the frame 4 in the embodiment described above. In addition, the above description has been given according to illustrated examples, but other arrangements may be made.

That is, the regulator 35 maybe in the form of a lengthwise elastically stretchable rubber string, in which case the regulator 35 may be tensioned at all times. The end of the regulator 35 may be removably connected to either the frame 4 or the net 6 by means of a hook. Further, the regulator 35 may be a rope or rubber string capable of adjusting its length.

Further, the end of each tensioner 36 may be removably connected to either the frame 4 or the net 6 by tying.

Further, the present invention may be accomplished by suitably combining aforesaid individual components.

What is claimed is:

1. A pitcher protection net device in baseball practice, comprising a frame installed on the ground to vertically extend to cover a pitcher from his front, and a net closing a space surrounded by the outer edge of said frame and attached to said frame, said frame comprising a main frame forming one lateral portion thereof on one widthwise side, and an auxiliary frame projecting from the lower portion of said main frame toward the other widthwise side to form the other lateral portion of said frame, characterized in that the pitcher protection net device in baseball practice includes an extension net that closes a corner space surrounded by the side edge of the upper portion of said main frame on said other side and the upper edge of said auxiliary frame and that is capable of deflecting downward, and an adjusting means for adjusting the amount of deflection of the upper edge of said extension net.

2. A pitcher protection net device in baseball practice as set forth in claim 1, characterized in that said adjusting means comprises a regulator preventing the amount of downward deflection of the upper edge of said extension net from exceeding a desired value, and tensioners making it possible to pull the upper edge of said extension net downward.

3. A pitcher protection net device in baseball practice as set forth in claim 1, characterized in that said net and said extension net are integrally formed to provide a combination net.

4. A pitcher protection net device in baseball practice as set forth in any one of claims 1 through 3, characterized in that said combination net is in the form of a bag capable of being fitted on said frame from above.

5. A pitcher protection net device in baseball practice as set forth in claim 4, characterized in that the side edge of said extension net is connected to the side edge of the upper portion of said main frame, while the lower edge of said extension net is connected to the upper edge of said auxiliary frame.

* * * * *